US005975951A

United States Patent [19]

Burris et al.

[11] Patent Number: 5,975,951

[45] Date of Patent: Nov. 2, 1999

[54] F-CONNECTOR WITH FREE-SPINNING NUT AND O-RING

[75] Inventors: Donald A. Burris, Peoria; William B. Lutz, Glendale; Herman P. Durst, Chandler, all of Ariz.

[73] Assignee: Gilbert Engineering Co., Inc., Glendale, Ariz.

[21] Appl. No.: 09/093,115

[22] Filed: Jun. 8, 1998

[51] Int. Cl.[6] ..... H01R 9/05

[52] U.S. Cl. ..... 439/585; 439/322

[58] Field of Search ..... 439/585, 583, 439/578, 584, 322

[56] References Cited

U.S. PATENT DOCUMENTS

| | | | |
|---|---|---|---|
| 3,184,706 | 5/1965 | Atkins | 339/496 |
| 4,156,554 | 5/1979 | Aujla | 339/177 |
| 4,400,050 | 8/1983 | Hayward | 339/177 |
| 4,408,821 | 10/1983 | Forney, Jr. | 339/177 |
| 4,834,675 | 5/1989 | Samchisen | 439/578 |
| 4,990,106 | 2/1991 | Szegda | 439/585 |
| 5,083,943 | 1/1992 | Tarrant | 439/583 |
| 5,338,225 | 8/1994 | Jacobsen et al. | 439/585 |
| 5,466,173 | 11/1995 | Down | 439/584 |
| 5,470,257 | 11/1995 | Szegda | 439/578 |
| 5,607,325 | 3/1997 | Toma | 439/578 |
| 5,667,405 | 9/1997 | Holliday | 439/585 |

FOREIGN PATENT DOCUMENTS 2019665 10/1979 United Kingdom .

*Primary Examiner*—Neil Abrams
*Assistant Examiner*—Javaid Nasri
*Attorney, Agent, or Firm*—Cahill, Sutton & Thomas, P.L.C.

[57] ABSTRACT

A coaxial cable F-connector (20) includes a tubular post (32) for insertion around the dielectric (26) of the coaxial cable (22), a cylindrical body member (46) secured to the tubular post for receiving the jacket (30) of the coaxial cable, and a coupling nut (38). The tubular post includes an enlarged shoulder (80) that extends inside the nut; the nut includes an inwardly directed collar (82) that extends around the tubular post and around one end of the cylindrical body member. An O-ring (35) is disposed around one end of the cylindrical body member between the shoulder of the tubular post and the collar of the coupling nut. Limited axial movement of the coupling nut is permitted relative to the tubular post and cylindrical body member for allowing the coupling nut to spin free of the O-ring until tightening of the coupling nut over the threaded port is almost complete. Upon final tightening of the coupling nut, the O-ring forms a seal between the nut, the tubular post, and the cylindrical body member.

5 Claims, 2 Drawing Sheets

F-CONNECTOR WITH FREE-SPINNING NUT AND O-RING

BACKGROUND OF THE INVENTION

1. Field of the Invention

The present invention relates generally to so-called F-connectors used primarily in the cable television industry to connect coaxial cables to threaded ports, and more particularly to such connectors using O-ring seals to exclude moisture when such connectors are installed outdoors.

2. Description of the Related Art

Coaxial cable F-connectors are often used to terminate a drop cable in a cable television system. The coaxial cable typically includes a center conductor surrounded by a dielectric, in turn surrounded by a conductive foil/grounding braid; the conductive foil/grounding braid is itself surrounded by a protective outer jacket The F-connector is secured over the prepared end of the jacketed coaxial cable, allowing the end of the coaxial cable to be threadedly connected with a threaded port of a terminal block.

Most F-connectors include certain basic components, including a tubular post, a coupling nut, and a cylindrical body member. The tubular post includes a tapered end that slides under the outer jacket of the cable and around the dielectric of the coaxial cable, allowing the central conductor and dielectric portions of the coaxial cable to pass therethrough. The cylindrical body surrounds the tubular post and receives the jacket and outer braid of the cable. The coupling nut serves to secure the F-connector onto a threaded terminal or post.

A variety of methods are known for securing an F-connector over the exposed end of a coaxial cable. For example, crimp style F-connectors are known wherein a crimp sleeve is included as part of the connector body. A special radial crimping tool, having jaws that form a hexagon, is used to radially crimp the crimp sleeve around the outer jacket of the coaxial cable to secure such a crimp style F-connector over the prepared end of the coaxial cable. Examples of such crimp connectors are disclosed within U.S. Pat. No. 4,400,050 to Hayward, assigned to Gilbert Engineering Co., Inc.; and U.S. Pat. No. 4,990,106 to Szegda, assigned to John Mezzalingua Assoc. Inc.

Still another form of F-connector is known wherein an annular compression sleeve is used to secure the F-connector over the prepared end of the cable. Rather than crimping a crimp leeve radially toward the jacket of the coaxial cable, these F-connectors employ a plastic annular compression sleeve that is initially attached to the F-connector, but which is detached therefrom prior to installation of the F-connector. The compression sleeve includes an inner bore for allowing such compression sleeve to be passed over the end of the coaxial cable prior to installation of the F-connector. The F-connector itself is then inserted over the prepared end of the coaxial cable. Next, the compression sleeve is compressed axially along the longitudinal axis of the connector into the body of the connector, simultaneously compressing the jacket of the coaxial cable between the compression sleeve and the tubular post of the connector. An example of such a compression sleeve F-connector is shown in U.S. Pat. No. 4,834,675 to Samchisen and assigned to LRC Electronics, Inc.; such patent discloses a compression sleeve type F-connector known in the industry as "Snap-n-Seal".

No matter the method used to secure the coaxial cable to the F-connector, the F-connector virtually always includes a rotatable nut for securing the F-connector to a threaded port. For F-connectors that are used exclusively indoors, the coupling nut can be free-spinning, as there is no need to create a moisture barrier between the coupling nut and other components of the F-connector. However, it is known in the art that the passage of moisture inside the F-connector can lead to corrosion, increased contact resistance, reduced signal strength, and excessive RF leakage from the connector. Accordingly, when such F-connectors must be used outdoors, those skilled in the art have made various efforts to form a seal between the various components of the F-connector, including the joint between the coupling nut and the tubular post of the F-connector.

For example, the practice of incorporating one or more resilient O-rings between various components of the F-connector has been used to seal out moisture. In U.S. Pat. No. 5,338,225 to Jacobsen, et al., an O-ring is positioned inside the coupling nut just ahead of the tubular post adjacent the internally threaded bore of the nut. However, in this case, the O-ring is contacted by the threaded post and can be degraded by such contact. Moreover, the O-ring is always bearing against both the coupling nut and the end of the tubular post, creating a drag effect that resists rotation of the coupling nut. In addition, such an O-ring does not create any seal between the tubular post and the cylindrical body, nor between the nut and the cylindrical body.

It is also known to dispose an O-ring near the opposite end of the coupling nut, trapped between a rearwardly-directed collar of the nut and the cylindrical body portion of the F-connector; such a structure is shown, for example, in the aforementioned U.S. Pat. No. 4,834,675. During assembly of the connector, the O-ring is pre-compressed between the coupling nut and the cylindrical body to create a seal therebetween; as in the prior example, such an O-ring constantly engages both the nut and the cylindrical body and creates drag therebetween which resists rotation of the nut. Furthermore, the forces created as the coupling nut is tightened over a threaded post or terminal have no impact on the degree of seal created between the coupling nut and the cylindrical body, i.e., further tightening of the coupling nut over the threaded terminal does not increase the amount of compression of the O-ring. Moreover, such an O-ring placement does not create any form of moisture seal as between the nut and the tubular post, nor as between the tubular post and the cylindrical body. In addition, the creation of the rearwardly-directed collar within the coupling nut increases manufacturing costs because the coupling nut must be machined from both ends thereof In most cases, a coaxial cable service technician threads the coupling nut over a threaded terminal by hand, until the nut is hand-tight. The technician then uses a wrench to make a final turn to secure the nut over the threaded terminal. The continuous drag applied by such O-rings to the coupling nut is a nuisance to service technicians, as compared with indoor-type free-spinning coupling nuts, because it is more difficult to rotate the coupling nut as it is being hand-tightened over the threaded post.

Accordingly, it is an object of the present invention to provide a simple and inexpensive F-connector that includes an O-ring for creating a seal between the coupling nut of the F-connector and at least one other component of the F-connector but which allows the coupling nut to remain free-spinning until the coupling nut begins to tighten about a threaded terminal.

It is another object of the present invention to provide such an F-connector that incorporates an O-ring for simultaneously forming a seal between the nut and the tubular post, and between the nut and the cylindrical body.

It is still another object of the present invention to provide such an F-connector which incorporates an O-ring for simultaneously forming a seal between the nut and the tubular post, and between the tubular post and the cylindrical body.

It is a further object of the present invention to provide such an F-connector which, upon being tightened over a threaded post, simultaneously forms a seal between the nut, the tubular post, and the cylindrical body.

A still further object of the present invention to provide such an F-connector wherein such O-ring lies internal to the F-connector and is not exposed to the threaded terminal over which the coupling nut is ultimately secured.

Yet another object of the present invention is to provide such an F-connector wherein the coupling nut can be machined from only one end thereof during manufacture in order to reduce manufacturing costs.

A further object of the present invention is to provide such an F-connector wherein the final tightening of the coupling nut over the threaded terminal actually serves to compress the O-ing to increase the sealing properties thereof These and other objects of the present invention will become more apparent to those skilled in the art as the description of the present invention proceeds.

SUMMARY OF THE INVENTION

Briefly described, and in accordance with the preferred embodiment thereof, the present invention is an F-connector for coupling the end of a coaxial cable to a threaded port and including a tubular post having a first end adapted to be inserted into an exposed end of the coaxial cable and having an opposing second end which includes an enlarged circular shoulder formed thereon. The F-connector also includes a generally cylindrical body member having a first end surrounding and spaced apart from the tubular post for receiving the cable jacket, and having an opposing second end engaging the tubular post near the second end thereof The F-connector further includes a nut having a first end for rotatably engaging the second end of the tubular post, and having an opposing second end with an internally threaded bore for threadedly engaging a threaded port. The first end of the nut has an inwardly directed collar with a circular aperture formed therein through which the second end of said tubular post extends; the circular aperture formed in this inwardly directed collar has a diameter less than the diameter of the enlarged circular shoulder of the tubular post to prevent the nut from falling off of the post.

The F-connector of the present invention also includes an O-ring disposed about the tubular post near the second end thereof between the enlarged circular shoulder of the tubular post and the inwardly directed collar of the nut. The nut can slide axially back and forth to a limited extent, i.e., the nut is permitted limited axial movement, relative to the tubular post before the nut is threadedly engaged with a threaded port. This limited axial movement allowing the nut to avoid significant engagement, or drag, with the O-ring, and to be free-spinning relative to the tubular post, until the nut begins to become tightened onto a threaded port. As the nut is further tightened over the threaded port, the collar of the nut and the shoulder of the tubular post are drawn toward each other, thereby compressing the O-ring therebetween to form a seal.

In the preferred embodiment of the present invention, the second end of the cylindrical body extends proximate the shoulder of the tubular post, and the inwardly directed collar of the nut extends around the second end of said cylindrical body member. The nut can slide axially back and forth, i.e., is permitted limited axial movement, relative to the second end of the cylindrical body member before the nut begins to become tightened onto a threaded port. Once again, this limited axial movement allows the nut to avoid significant engagement with the O-ring, and thereby avoid any drag which would inhibit the rotation of the nut relative to both the tubular post and the second end of said cylindrical body, until the nut is tightened onto a threaded port.

In the preferred embodiment of the F-connector of the present invention, the inwardly directed collar of the nut faces the second end of the cylindrical body member, and wherein the O-ring is bounded by the collar of the nut, the shoulder of the tubular post, and the second end of the cylindrical body to simultaneously form a seal a) between the nut and the tubular post; b) between the nut and the second end of the cylindrical body; and c) between the second end of the cylindrical body and the tubular post, as the nut becomes tightened onto a threaded port. Preferably, the inwardly directed collar of the nut includes a tapered flange for urging the O-ring forwardly against the shoulder of the tubular post and inwardly against the second end of the cylindrical body member as the nut becomes tightened on the threaded port. The O-ring is simultaneously compressed between the shoulder of the tubular post, the tapered flange of the collar of the nut, and the second end of the cylindrical body member, as the nut is tightened onto a threaded post. Likewise, the second end of the cylindrical body member preferably includes a tapered flange urging the O-ring forwardly against the shoulder of the tubular post and inwardly against the collar of the nut as the nut becomes tightened onto a threaded port.

DETAILED DESCRIPTION OF THE PREFERRED EMBODIMENT

Figure 1:
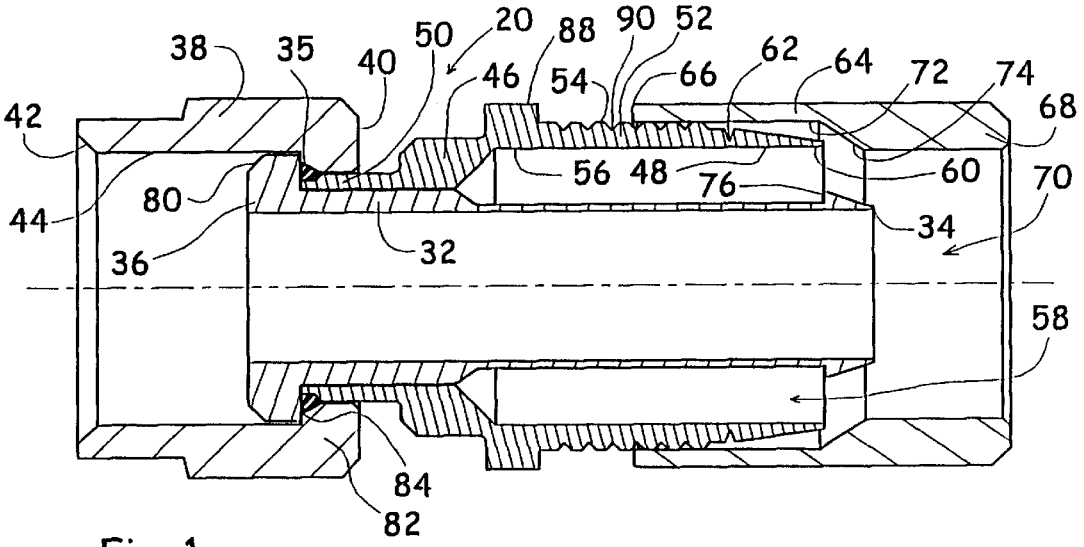
FIG. 1 is a cross-sectional view of an F-connector fitting constructed in accordance with the present invention.
Figure 2:
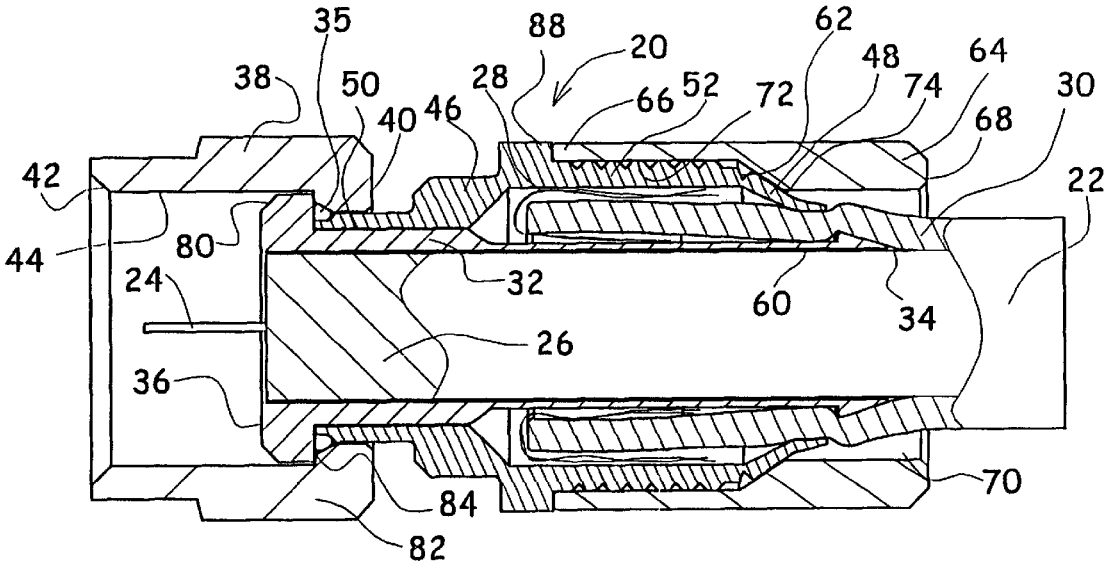
FIG. 2 is a cross-sectional view of the F-connector fitting shown in FIG. 1 after being installed over the prepared end of a coaxial cable and being axially compressed by an axial compression tool.

FIG. 1 illustrates in cross-section an F-connector constructed in accordance with a preferred embodiment of the present invention and is designated generally by reference numeral 20. F-connector 20 can be used to couple the end of a coaxial cable to a threaded port (not shown). Referring briefly to FIG. 2, coaxial cable 22 has a center conductor 24 surrounded by a dielectric layer 26; in turn, dielectric layer 26 is surrounded by a conductive foil/grounding braid 28 covered by a protective outer cable jacket 30.

F-connector 20 of FIG. 1 includes a tubular post 32 preferably made of metal and having a first end 34 adapted to be inserted into the exposed end of coaxial cable 22 around the dielectric 26 thereof and under the conductive grounding braid 28. Tubular post 32 also has an opposing second end 36. F-connector 20 also includes a nut 38 having a first end 40 for rotatably engaging second end 36 of tubular post 32 and having an opposing second end 42 with an internally threaded bore 44 for threadedly engaging a threaded port (not shown).

F-connector 20 further includes a cylindrical body member 46 also made of metal and having a first end 48 and a second end 50. First end 48 of cylindrical body member 46 includes a cylindrical sleeve 52 having an outer wall 54 of a first predetermined diameter and an inner wall 56 bounding a first central bore 58 extending about tubular post 32. Second end 50 of cylindrical body member 46 is of a smaller diameter than first end 48 thereof, and engages tubular post 32 proximate its second end 36. Cylindrical sleeve 52 has an open rear end portion 60 for receiving he outer jacket 30 of coaxial cable 22; this rear end portion 60 is deformable. As shown in FIGS. 1 and 2, cylindrical sleeve 52 has a circular relief, or weakened area 62, formed therein as by cutting a circular groove thereabout, to facilitate bending of cylindrical sleeve 52 at such point.

Figure 3:
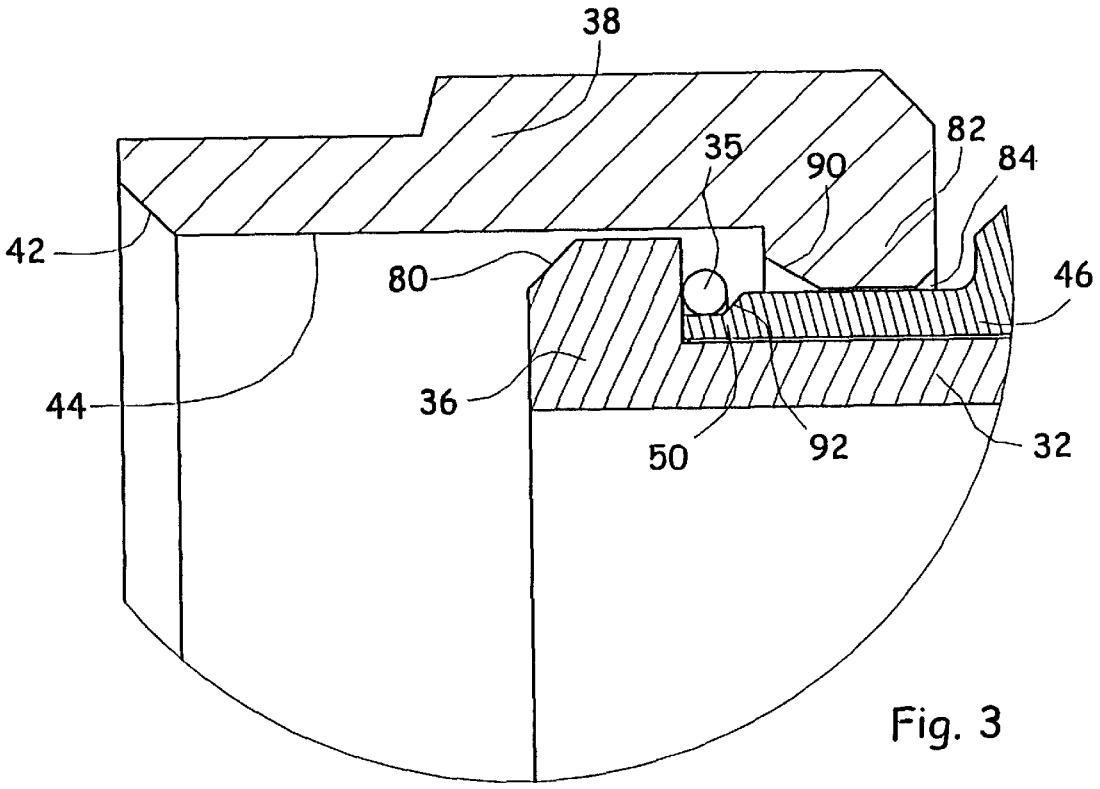
FIG. 3 is an enlarged view of the interface between the nut, tubular post, cylindrical body member, and O-ring before the F-connector is fully-tightened to a threaded terminal.

Still referring to FIGS. 1 and 2, F-connector 20 also includes a compression ring 64 having a first end 66 and an opposing second end 68. Compression ring 64 is also preferably made of metal. A central passageway 70 extends through compression ring 64 between first end 66 and second end 68. A portion of central passageway 70 is formed by a first internal bore 72 communicating with the first end 66 of compression ring 64. First internal bore 72 has a diameter commensurate with the outer diameter of outer wall 54 of cylindrical sleeve 52 for allowing first end 66 of compression ring 64 to extend over first end 48 of cylindrical body member 46. Central passageway 70 of compression ring 64 also includes an inwardly tapered annular wall 74 leading from first internal bore 72 and narrowing to a reduced diameter as compared with the internal diameter of first internal bore 72. This inwardly tapered annular wall 74 causes the rear end portion 60 of cylindrical sleeve 52 to be deformed inwardly toward tubular post 32 and against cable jacket 30, as shown in FIGS. 2 and 3, as compression ring 64 is advanced axially over cylindrical body member 46 toward the second end 50 thereof In order to maximize retention strength of the cable jacket within F-connector 20, tubular post 32 has a circular barb 76 formed thereabout proximate its first end 34. Cylindrical sleeve 52 initially extends axially to a point proximate circular barb 76. During axial compression of F16 connector 20, inward deformation of the rear end portion 60 of cylindrical sleeve 52 caused by the dvancement of compression ring 64, and hence tapered annular wall 74, results in rear end portion 60 being flattened just behind barb 76; cable jacket 30 is thereby pinched between deformed rear end 60 of cylindrical sleeve 52 and barb 76 in a snakelike path to increase the pull21 out force required to dislodge cable 22 from F-connector 20.

Referring again to FIGS. 1 and 2, O-ring 35 is disposed between tubular post 32, nut 38, and the second end 50 of cylindrical body member 46. The second end 36 of tubular post 32 includes an enlarged circular shoulder 80 formed thereon. The outer diameter of shoulder 80 exceeds the diameter elsewhere along tubular post 32. The first end 40 of nut 38 includes an inwardly directed collar 82 with a circular aperture 84 formed therein through which second end 36 of tubular post 32 extends. Circular aperture 84 has a diameter that is less than the diameter of enlarged circular shoulder 80 to prevent nut 38 from falling off of tubular post 32.

Figure 4:
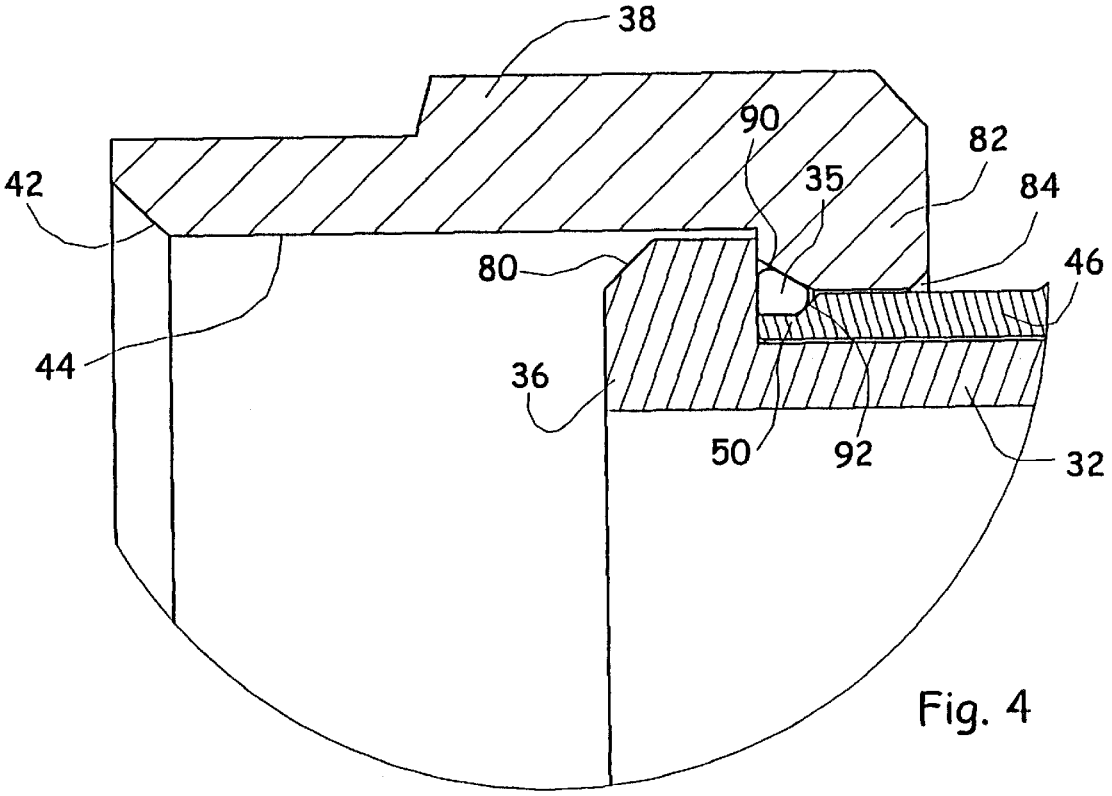
FIG. 4 is an enlarged view of the interface between the nut, tubular post, cylindrical body member, and O-ring after the F-connector is fully-tightened to a threaded terminal.

Referring to FIGS. 1–4, circular O-ring 35 is disposed about tubular post 32 proximate the second end 36 thereof between the enlarged circular shoulder 80 of tubular post 32 and the inwardly directed collar 82 of nut 38. As shown in FIGS. 3 and 4, nut 38 is permitted limited axial movement relative to tubular post 32 before nut 38 becomes tightened upon a threaded port (not shown). In FIG. 3, shoulder 80 of tubular post 32 is moved slightly away from inwardly directed collar 82 of nut 38, thereby allowing collar 82 to spin freely without excessive drag on O-ring 35. However, as nut 38 becomes tight on a threaded port, inwardly directed collar 82 of nut 38 is drawn toward shoulder 80 of tubular post 32, thereby compressing O-ring 35 between collar 82 shoulder 80 to form a seal therebetween.

As shown best in FIGS. 3 and 4, inwardly directed collar 82 of nut 38 extends around second end 50 of cylindrical body member 46. As mentioned above, nut 38 is permitted limited axial movement relative to second end 50 of cylindrical body member 46 before nut 38 begins to become tight on the threaded port. This limited axial movement allows nut 38 to avoid significant engagement with O-ring 35, and to be free-spinning relative to both tubular post 32 and second end 50 of cylindrical body member 46, until nut 38 is tightened onto a threaded port.

As shown in FIG. 4, when nut 38 is fully tightened over a threaded terminal, O-ring 35 is bounded by collar 82 of nut 38, by shoulder 80 of tubular post 32, and by second end 50 of cylindrical body member 46 to simultaneously form a seal a) between nut 38 and tubular post 32; b) between nut 38 and second end 50 of cylindrical body member 46; and c) between second end 50 of cylindrical body member 46 and tubular post 32.

As indicated in FIGS. 3 and 4, inwardly directed collar 82 of nut 38 preferably includes a tapered flange 90 urging O-ring 35 forwardly against shoulder 80 of tubular post 32 and inwardly against the second end 50 of cylindrical body member 46 as nut 38 is tightened over a threaded port. O-ring 35 is simultaneously compressed between shoulder 80 of tubular post 32, tapered flange 90 of collar 82 of nut 38, and the second end 50 of cylindrical body member 46, as nut 38 is tightened onto a threaded post. Likewise, second end 50 of cylindrical body member 46 preferably includes a tapered flange 92 which urges O-ring 35 forwardly against shoulder 80 of tubular post 32 and inwardly against collar 82 of nut 38 as nut 38 is tightened onto a threaded port; thus, O-ring 35 is simultaneously compressed between shoulder 80 of tubular post 32, tapered flange 90 of collar 82, and tapered flange 92 of second end 50 of cylindrical body member 46.

While the present invention has been described with respect to preferred embodiments thereof, such description is for illustrative purposes only, and is not to be construed as limiting the scope of the invention. Various modifications and changes may be made to the described embodiments by those skilled in the art without departing from the true spirit and scope of the invention as defined by the appended claims.

We claim:

1. A connector for coupling the end of a coaxial cable to a threaded port, the coaxial cable having a center conductor surrounded by a dielectric, the dielectric being surrounded by a grounding conductor, and the grounding conductor being surrounded by a protective outer jacket, said connector comprising in combination:

a. a tubular post extending along a longitudinal axis and having a first end adapted to be inserted into an exposed end of the coaxial cable around the dielectric thereof and within the outer jacket thereof, said tubular post having an opposing second end, said second end having an enlarged circular shoulder formed thereon of a first predetermined diameter;

b. a generally cylindrical body member having a first end and a second end, the first end of said cylindrical body member defining a first central bore and surrounding the tubular post and being spaced apart therefrom for receiving the outer jacket of the coaxial cable, the second end of said cylindrical body member engaging said tubular post proximate the second end of said tubular post;

c. a nut having a first end for rotatably engaging the second end of said tubular post, said nut having an opposing second end with an intern/ally threaded bore for threadedly engaging the threaded port, the first end of said nut having an inwardly directed collar with a circular aperture formed therein through which the second end of said tubular post extends, the circular aperture having a diameter less than said first predetermined diameter of said enlarged circular shoulder to prevent said nut from falling off of the post;

d. an O-ring disposed about said tubular post proximate the second end thereof and disposed between the enlarged circular shoulder of said tubular post and the first end thereof, and disposed between the enlarged circular shoulder of said tubular post and the inwardly directed collar of said nut;

e. said nut being permitted limited axial movement relative to said tubular post before said nut threadedly engages the threaded port, said limited axial movement allowing said nut to avoid significant engagement between the collar thereof and said O-ring, and to be free-spinning relative to said tubular post, until said nut is tightened onto the threaded port; and f. said O-ring being compressed between the collar of said nut and the shoulder of said tubular post to form a seal therebetween as said nut is tightened onto the threaded port.

2. The connector recited by claim 1 wherein the inwardly directed collar of said nut extends around the second end of said cylindrical body member, and wherein said nut is permitted limited axial movement relative to the second end of said cylindrical body member before said nut threadedly engages the threaded port, said limited axial movement allowing said nut to avoid significant engagement with said O-ring, and to be free-spinning relative to both said tubular post and said second end of said cylindrical body, until said nut is tightened onto a threaded port.

3. The connector recited by claim 1 wherein the inwardly directed collar of said nut extends around the second end of said cylindrical body member, and wherein said O-ring is bounded by the collar of said nut, the shoulder of said tubular post, and the second end of said cylindrical body to simultaneously form a seal a) between said nut and said tubular post; b) between said nut and the second end of said cylindrical body; and c) between the second end of said cylindrical body and said tubular post; as said nut is tightened onto the threaded port.

4. The connector recited by claim 3 wherein the inwardly directed collar of said nut includes a tapered flange urging said O-ring forwardly against the shoulder of said tubular post and inwardly against the second end of said cylindrical body member as said nut is tightened over the threaded port, said O-ring being simultaneously compressed between the shoulder of said tubular post, the tapered flange of the collar of said nut, and the second end of said cylindrical body member, as said nut is tightened onto the threaded post.

5. The connector recited by claim 3 wherein the second end of said cylindrical body member includes a tapered flange urging said O-ring forwardly against the shoulder of said tubular post and inwardly against the collar of said nut as said nut is tightened onto the threaded port, said O-ring being simultaneously compressed between the shoulder of said tubular post, the collar of said nut, and the tapered flange of the second end of said cylindrical body member, as said nut is tightened onto the threaded post.

* * * * *